United States Patent [19]

Lingl, Jr.

[11] Patent Number: 4,778,384

[45] **Date of Patent: * Oct. 18, 1988**

[54] MULTITRAIN TUNNEL KILN ESPECIALLY ADAPTED FOR THE UNDERSIDE COOLING OF KILN CARS

[76] Inventor: Hans Lingl, Jr., An der Schiessmauer 46, D-7910, Neu-Ulm, Fed. Rep. of Germany

[ * ] Notice: The portion of the term of this patent subsequent to Feb. 2, 2005 has been disclaimed.

[21] Appl. No.: 108,006

[22] Filed: Oct. 14, 1987

Related U.S. Application Data

[63] Continuation-in-part of Ser. No. 930,924, Nov. 17, 1986, Pat. No. 4,722,682, and a continuation-in-part of Ser. No. 011,948, Feb. 6, 1987, Pat. No. 4,744,750.

[30] Foreign Application Priority Data

Nov. 19, 1985 [DE] Fed. Rep. of Germany ..... 3541015
Feb. 13, 1986 [DE] Fed. Rep. of Germany ..... 3604501
Aug. 4, 1987 [DE] Fed. Rep. of Germany ..... 3725857

[51] Int. Cl.[4] ..... F27D 3/12; F27B 9/26

[52] U.S. Cl. ..... 432/241; 432/137; 432/141

[58] Field of Search ..... 432/137, 141, 241

[56] References Cited

U.S. PATENT DOCUMENTS

| | | | |
|---|---|---|---|
| 1,965,832 | 7/1934 | Hartford et al. | 432/137 |
| 2,191,438 | 2/1940 | Breeler | 432/137 |
| 4,069,010 | 1/1978 | Fay | 432/137 |
| 4,320,612 | 3/1982 | Jeffries, Jr. | 432/241 |
| 4,375,354 | 3/1983 | Henriksson | 432/241 |
| 4,421,481 | 12/1983 | Holz et al. | 432/137 |
| 4,482,314 | 1/1984 | Giese et al. | 432/137 |
| 4,504,221 | 3/1985 | Hartmann | 432/241 |
| 4,560,350 | 12/1985 | Doby | 432/241 |
| 4,609,345 | 9/1986 | Schroder et al. | 432/137 |
| 4,615,676 | 10/1986 | Corato | 432/137 |

FOREIGN PATENT DOCUMENTS 0086693 8/1983 European Pat. Off. .

OTHER PUBLICATIONS

Tunnelofen fur Verblendziegel Tunnel Kiln for facing bricks Four-tunnel pour briiqueso de parement by Lingl (2 pages).

*Primary Examiner*—Henry C. Yuen
*Attorney, Agent, or Firm*—Nixon & Vanderhye

[57] ABSTRACT

The tunnel kiln establishes multiple kiln car train paths by a pedestal which upwardly projects from the kiln's foundation. Aprons which depend from the kiln cars and extend transversely between laterally adjacent pedestals (or a pedestal and a side wall of the tunnel) thus effectively form a seal thereat so that the undercar cooling techniques may be employed in multitrain tunnel kilns.

14 Claims, 4 Drawing Sheets

MULTITRAIN TUNNEL KILN ESPECIALLY ADAPTED FOR THE UNDERSIDE COOLING OF KILN CARS

CROSS-REFERENCE TO RELATED APPLICATIONS

This application is a continuation-in-part of my earlier U.S. patent application Ser. Nos. 930,924, filed Nov. 17, 1986, now U.S. Pat. No. 4,722,682, and 011,948 filed Feb. 6, 1987, now U.S. Pat. No. 4,744,750 the entire contents of each of these earlier applications being expressly incorporated hereinto by reference.

FIELD OF INVENTION

This invention is generally directed to multitrain tunnel kilns especially well suited for cooling the undersides of kiln cars located therein. It includes specially adapted kiln cars as well as an especially adapted tunnel kiln and the system comprising such specially adapted kiln cars and kiln.

BACKGROUND AND SUMMARY OF INVENTION

For various reasons, it is often necessary to insure that the underside of a kiln car is maintained in a relatively cooler atmosphere than the upper deck side (on which uncured ceramic materials are typically carried for firing in the kiln). For example, it may be necessary to achieve sufficient cooling to avoid overheating of mechanisms such as kiln car wheels or the like located beneath the deck of a kiln car.

In general, the foundation and lower side walls of the tunnel kiln may be cooled in an attempt to dissipate heat flowing through the deck of kiln cars to avoid such overheating. One typical prior art practice is to attempt cooling of the undercar channel by means of air drawn through the undercar channel from the exit end of the tunnel kiln toward its entrance end. The firing channel of the tunnel kiln is typically also flushed with gases flowing the same direction so that a pressure gradient develops in both channels (i.e., the firing channel located above the car decks and the undercar channel located therebelow) from the exit end towards the entrance end of the tunnel.

However, because there are different gas flow resistances in the two different channels, the pressure gradient is different as a function of distance along the tunnel thereby leading to "false" air flows between the two channels. Such air flows between the two channels is a situation which must be avoided by appropriate measures so as to avoid undue heating of the undercar channel (or undue cooling of the firing channel).

In my related parent application Ser. No. 903,924 filed Nov. 17, 1986, now U.S. Pat. No. 4,722,682, I describe a system which permits controlled cooling along a tunnel kiln utilizing convection currents in divided cooling sub-chambers formed along the length of the undercar channel. By blocking the longitudinal flow of air along the undercar channel, it is possible to permit local pressure equalizations vertically to the upper firing channel and thus reduce the need for the traditional horizontal pressure seal along the tunnel length.

According to my other related U.S. Pat. No. 4,744,750 problems which may arise when an existing tunnel kiln is retrofitted with cooling sub-chambers are alleviated by a system which accomplishes undercar cooling near the end of the firing zone and in the cooling zone of a tunnel kiln. Thus, the improved undercar cooling system of U.S. Pat. No. 4,744,750 can be economically retrofitted to existing tunnel kilns—while still reducing the requirement for a traditional horizontal seal arrangement.

It will be understood that the sides of kiln cars typically travel in close proximity to the tunnel side walls. One conventional method for sealing the moving kiln car sides to the kiln side walls is to provide aprons along the longitudinal car sides which dip into sand filled channels in skirting of the kiln side walls such that the sand forms a closed barrier extending the length of the kiln. Transverse joints between successive kiln cars may be sealed by means of conventional elastic material cords (e.g., see Lingl Leaflet F045/3 dated July 1982).

Although the purpose of such prior sand barriers is to substantially prevent pressure equalization between the undercar channel and the firing channel, it is far from a perfect seal. In the first place, for design and cost reasons, the depth to which such aprons dip into the sand must be comparatively small. In addition, the sand must be made comparatively course so that it will be heavy enough so as not to be blown out of the barrier area and entrained in the moving gas flows. As a result, the sand barrier actually is permeable to gas and provides a far from perfect seal.

Another prior approach (EP OS 0, 086,693) uses a kiln car including a box-like structure open at the bottom and provided with sheet metal aprons extending all about the car. At the entrance to the tunnel kiln, each car is lowered into a running fluid bath which provides a continuous hydraulic seal below the car train. The fluid is circulated under the cars for cooling purposes. However, in addition to requiring lowering and lifting devices for each kiln car at the entrance and exit of the tunnel kiln, the cooling fluid is entrained in one large continuous container so that it is not possible to control the degree of cooling as a function of position along the tunnel kiln. For example, heat is undesirably removed even in the initial heat-up zone of the tunnel kiln where undercar cooling is neither necessary nor desirable (e.g., because it ultimately removes heat from the firing channel which, at this point, is contrary to the desired purpose of getting the top-side of the car and material carried thereon up to kiln curing temperatures as fast as possible).

It is also known to provide multiple trains of kiln cars travelling parallel to one another in side-by-side fashion through an appropriately configured multilane tunnel kiln having no intermediate longitudinal walls disposed between adjacent kiln car trains. Such conventional kiln cars have typically been equipped with the same conventional aprons described above which dip into sand-filled channels disposed laterally of each train. The problems associated with this conventional "sand trough" sealing technique for a single train of kiln cars increases when multiple kiln car trains are employed. For example, greater lateral distances are needed between adjacent kiln car trains so as to accommodate the required volume of sand in the channels to seal each of the multiple trains as effectively as for a single train. This undesirably disrupts the gas flow conditions existing in the firing channel. Furthermore, the increased number of sand-filled channels in multitrain kiln tunnels accentuates the "leaks" between the firing channel and the undercar channel that are present with a single train kiln thereby rendering it more difficult to heat the material on the kiln cars to the desired kiln temperature in the heating zone. For these reasons, multitrain tunnels have not, in practice, been constructed for quite some time.

It would therefore be quite advantageous if a multitrain kiln tunnel was provided which minimizes "leaks" between the firing and undercar channels while yet capable of providing undercar cooling in accordance with my earlier patent applications.

I have now discovered a multitrain kiln tunnel which provides an almost perfect seal between the firing and undercar channels without resort being made to intermediate continuous walls positioned between adjacent kiln car trains and which permits the distance between adjacent kiln car trains to be maintained at an acceptably small dimension. Furthermore, my novel multitrain kiln tunnel facilitates the use of the more narrow kiln cars customarily associated with older multitrain tunnel kilns with minimal conversion thereof.

According to this invention, there is provided a multilane tunnel kiln having a longitudinal pedestal positioned between adjacent kiln car trains. The kiln cars themselves are provided with depending aprons on their leading and/or trailing faces so that little (e.g. 10 millimeters or less) clearance, if any, exists between the aprons, on the one hand, and the bottom of the tunnel kiln and laterally adjacent pedestals (or a laterally adjacent pedestal and the kiln wall), on the other hand. Thus, undercar cooling can now be accomplished in a multitrain tunnel kiln employing the techniques of my earlier U.S. Pat. No. 4,744,750—that is, employing a continuous undercar channel (e.g., depressed continuously below such car aprons) in the latter half of the undercar channel (i.e., from mid-firing zone through the cooling zone).

If desired, the depressed undercar channel provided only along the latter portion of the kiln may include plural sub-chambers disposed therealong beneath the intended track of the multiple trains of kiln cars (i.e., similar to the system described in my earlier U.S. Pat. No. 4,722,682). Gas flows to and from each of the sub-chambers in this alternate embodiment are substantially isolated and prevented except for that required to equalize pressure between the sub-chamber and the section of the firing channel located directly thereabove. A heat exchanger provides cooling within the sub-chamber thus setting up convection currents within the sub-chamber which tend to cool the underside of the kiln car located directly thereabove. Individual sub-chambers may be cooled differently as a function of prevailing temperature. However, since there is no substantial gas flow into or out of the sub-chamber, there is no substantial leakage gas flow between the cooling channel and the firing channel. This alternate embodiment thus generally utilizes the techniques described in my copending parent application Ser. No. 930,924, now U.S. Pat. No. 4,722,682.

Preferably, a radiation blocking structure is employed in the pressure equalization passage located between the cooling channel and the firing channel so as to prevent direct radiation transfers of heat energy from the firing channel into the cooling channel.

The advantages of this invention can be achieved, at least in part, because intensive undercar cooling is limited to the latter portion of the kiln (e.g., mid firing zone through cooling zone) where expected undercar temperatures make such cooling necessary—while minimizing inter-channel leakage in the initial portion of the kiln (e.g., the heat-up zone).

As a result, sand filled channels or other types of attempted "perfect" seals between the firing channel and the undercar cooling channel are no longer required thereby permitting, in a multitrain kiln, the kiln trains to be closely positioned adjacent one another in the kiln. And, as an added advantage, the undercar channel can be cooled at different rates in different sections or sub-chambers as a function of position along the tunnel kiln. Furthermore, the kiln cars can continue to be transported along a rail system in the same plane both inside and outside the tunnel kiln so that lifting or lowering devices are avoided. This greatly facilitates movement and circulation of the kiln cars with conventional apparatus and existing facilities which can be retrofitted or converted after the fact to practice the present invention.

BRIEF DESCRIPTION OF ACCOMPANYING DRAWINGS

These as well as other objects and advantages of this invention will be more completely understood and appeciated by carefully studying the following detailed description of a presently preferred exemplary embodiment taken in conjunction with the drawings, of which:

DETAILED DESCRIPTION OF INVENTION

Figure 4:
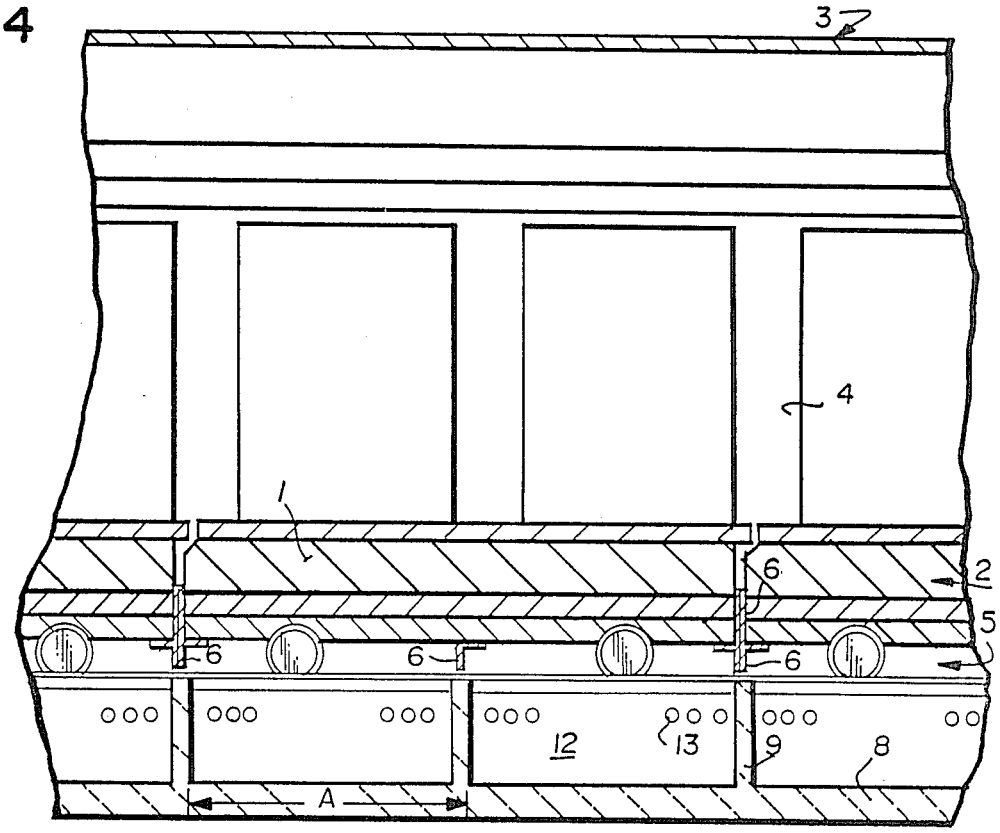
FIG. 4 is a schematic longitudinal section through the tunnel kiln of FIG. 3.

Referring to the drawings, a kiln car train 2 includes a plurality of closely spaced rail-mounted kiln cars 1 which is typically pushed through a tunnel kiln 3. The deck of the kiln cars passes in close adjacency to the lower side walls of the tunnel kiln thus "closing" the bottom of a firing channel 4 and separating it from an undercar cooling channel 5. In the exemplary embodiments, the end of each kiln car 1 is provided with an apron 6 (e.g., made of ordinary steel plate) which depends downwardly toward the rails 10. If desired, an additional apron 6 may be disposed at other predetermined locations such as depicted at FIG. 4 at the middle of each kiln car. The aprons 6 are disposed with little (e.g., 10 millimeters or less), if any, clearance with respect to the kiln walls 7 so that they act as seals. A projecting course 15 of soft insulating refractory material is disposed along the side of each kiln car 1 so as to pass with very little clearance from a projecting course 14 located on the kiln wall 7. This interdigitated structure of refractory material serves as a radiation barrier so as to prevent the transfer of heat energy by direct radiation from the firing chamber 4 to the cooling chamber 5.

In an area, beginning at the most, in the middle of the firing zone and extending over a substantial length of the cooling zone, the foundation 8 of the kiln 3 takes the form of a trough with the floor of the foundation 8 lowered far enough to provide a continuous, depressed undercar channel 5' below the aprons 6.

Figure 1:
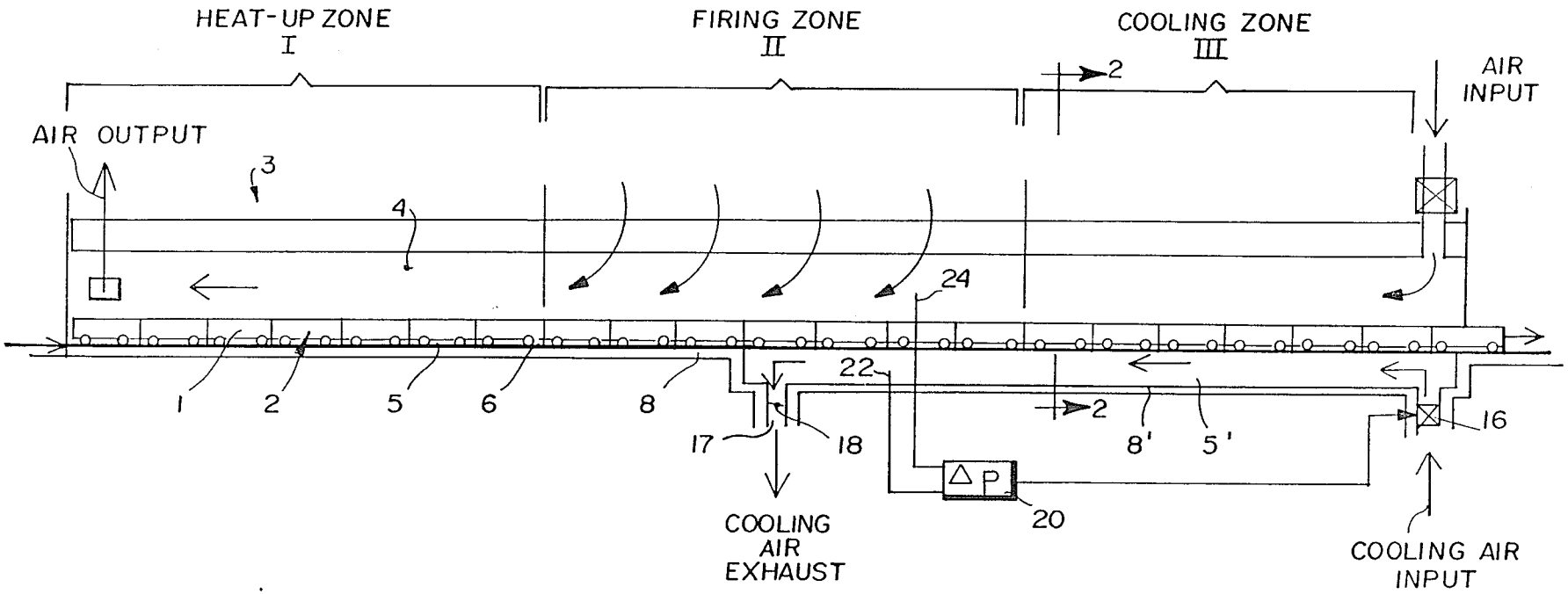
FIG. 1 is a schematic longitudinal cross-sectional view through a tunnel kiln modified so as to practice this invention.
Figure 2:
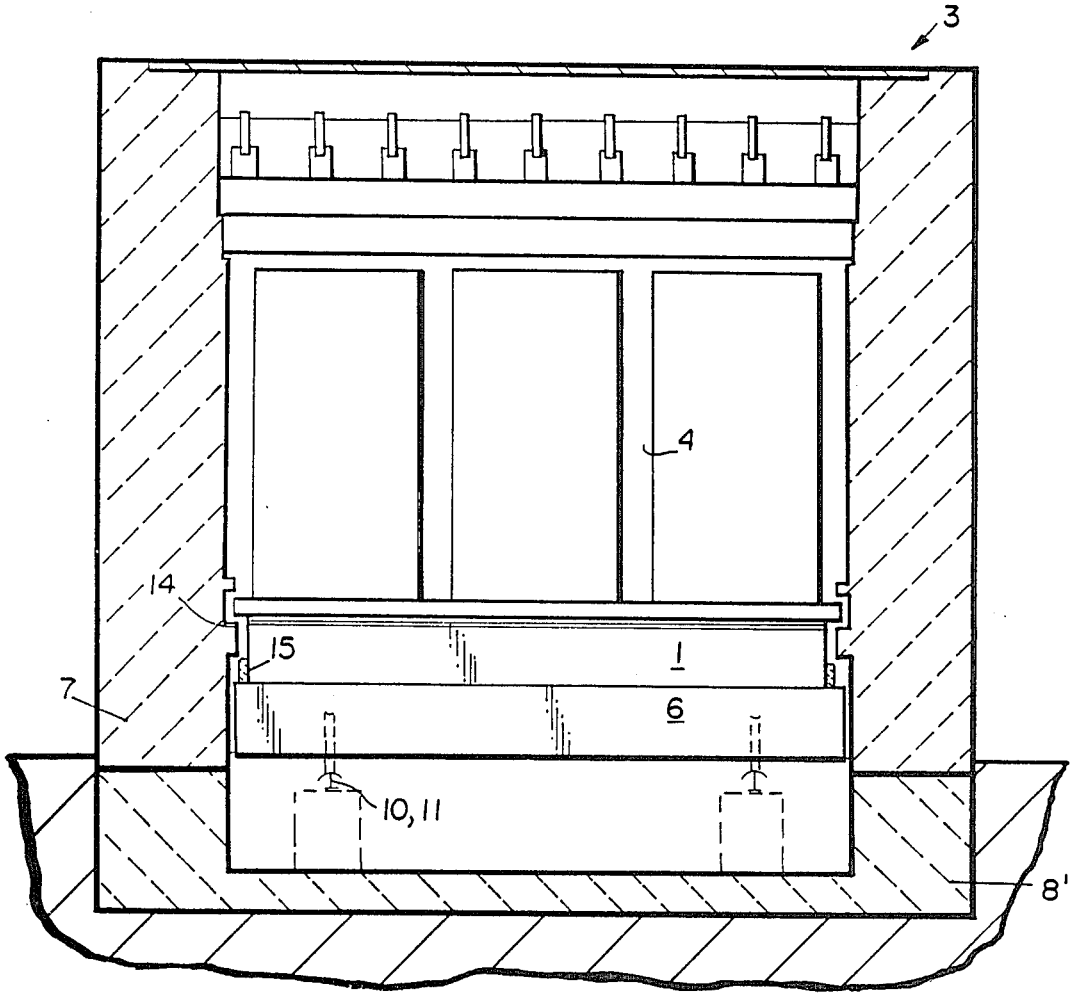
FIG. 2 is a schematic cross-sectional view through the tunnel kiln of FIG. 1 illustrating the depressed undercar channel below depending aprons on a train of kiln cars in a kiln system adapted to practice this invention.

According to one embodiment of the invention (FIGS. 1 and 2 using techniques discussed in my co-pending parent application Ser. No. 011,948 now U.S. Pat. No. 4,744,750), a fan 16 is disposed in the depressed undercar channel 5' at the exit end of the cooling zone III by means of which cooling air is blown into the depressed undercar channel 5' which can be exhausted through an opening 17 in the area of the firing zone II. The opening 17 can be closed by means of a damper 18 which can be controlled either manually or as a function of the temperature in the depressed undercar channel 5'. The output of the fan 16 may be controlled by a conventional controller as a function of the pressure difference between the depressed undercar channe) 5' and the firing channel 4 in the area of the firing zone II as sensed by pressure sensor 22 and 24. This pressure difference should be kept as constant as possible. Depending aprons 6 extend substantially to the kiln floor in the heat-up zone (through to the start of depressed channel 5') so as to prevent substantial longitudinal air flows in this section of the kiln.

Figure 3:
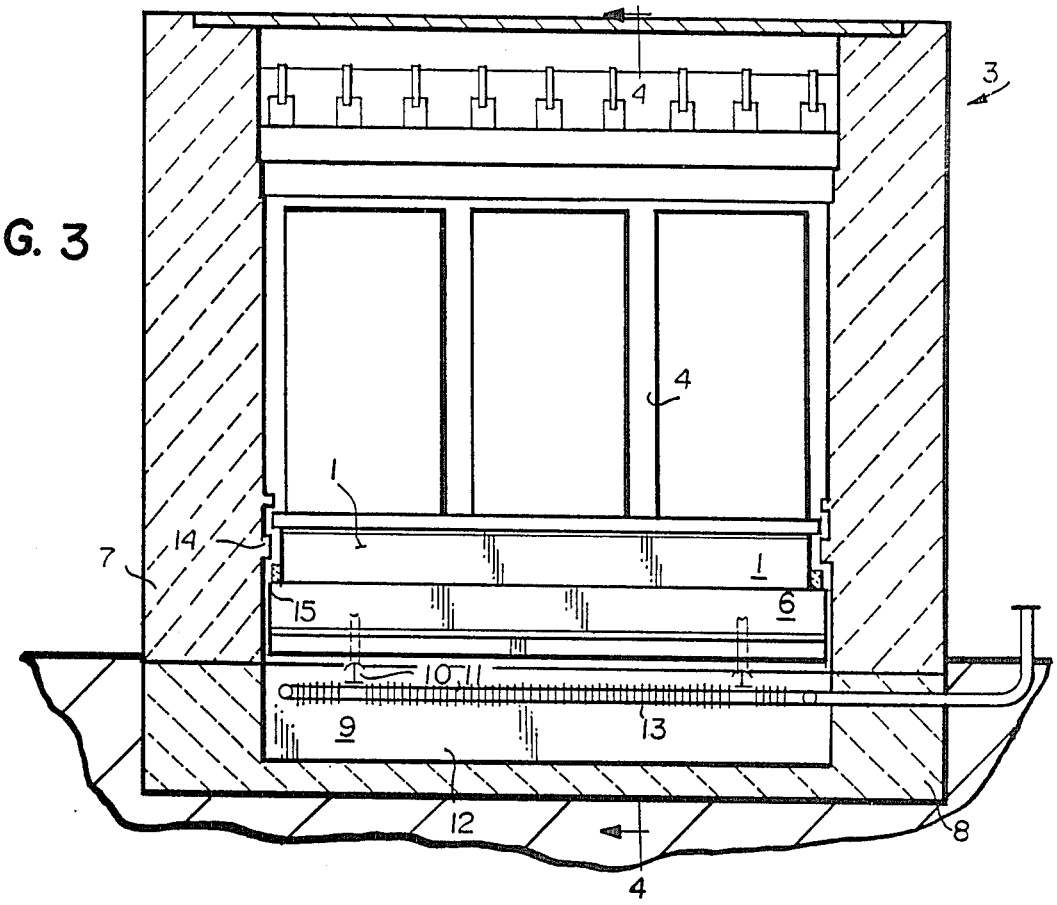
FIG. 3 is a schematic cross-sectional view through the tunnel kiln of FIG. 1 modified so as to practice a second embodiment of this invention.

According to another embodiment of the invention (shown in FIGS. 3 and 4 using techniques discussed in my copending parent application No. 930,924), the depressed undercar channel 5' is divided into a plurality of individual sections or sub-chambers by means of partitions 9 spaced apart by distance A which corresponds to the distance between aprons 6 (or a multiple thereof). As will be understood in a typical "intermittent" kiln, the train of kiln cars is intermittently advanced by a predetermined increment of distance (e.g., distance A).

The transverse partitions 9 extend upwardly to the level of the track rail tops so that the clearance between the bottom of aprons 6 and the top of partitions 9 (or the floor of channel 5 in the heat-up zone) is nonexistent or only very small (e.g., 10 millimeters or less) so as to effectively result in a "tight" seal preventing substantial gas flows therethrough.

The kiln car rails 10 are supported by means of conventional beams 11 to bridge the sub-chambers 12 formed by this type of structure. Directly below the beams 11 are heat exchanger cooling pipes 13 disposed so as to set up a natural circulation of air by convection currents within each of the sub-chambers 12. By controlling the passage of coolant fluid within heat exchange pipes 13, the intensity of such convection air currents can be controlled in sections corresponding to the length of each sub-chamber or multiples thereof.

Since there is no attempt to make a gas tight seal vertically between firing chamber 4 and cooling chamber 5 along the sides of the tunnel kiln, pressure equalization can freely take place between the firing channel 4 and the undercar channels 5 and 5'. However, since there is otherwise no significant air supplied to or removed from the undercar channel 5 (nor any of the effectively isolated sub-chambers 12 in the alternate embodiment), there is no significant leakage air flow. In other words, the very small gap that may still exist between aprons 6, partitions 9 and kiln wall 7 (and the kiln floor in the heat-up zone) does not permit any significant longitudinal gas flow along the undercar channel 5 (or 5' in the case of the FIGS. 3, 4 embodiment).

Figure 5:
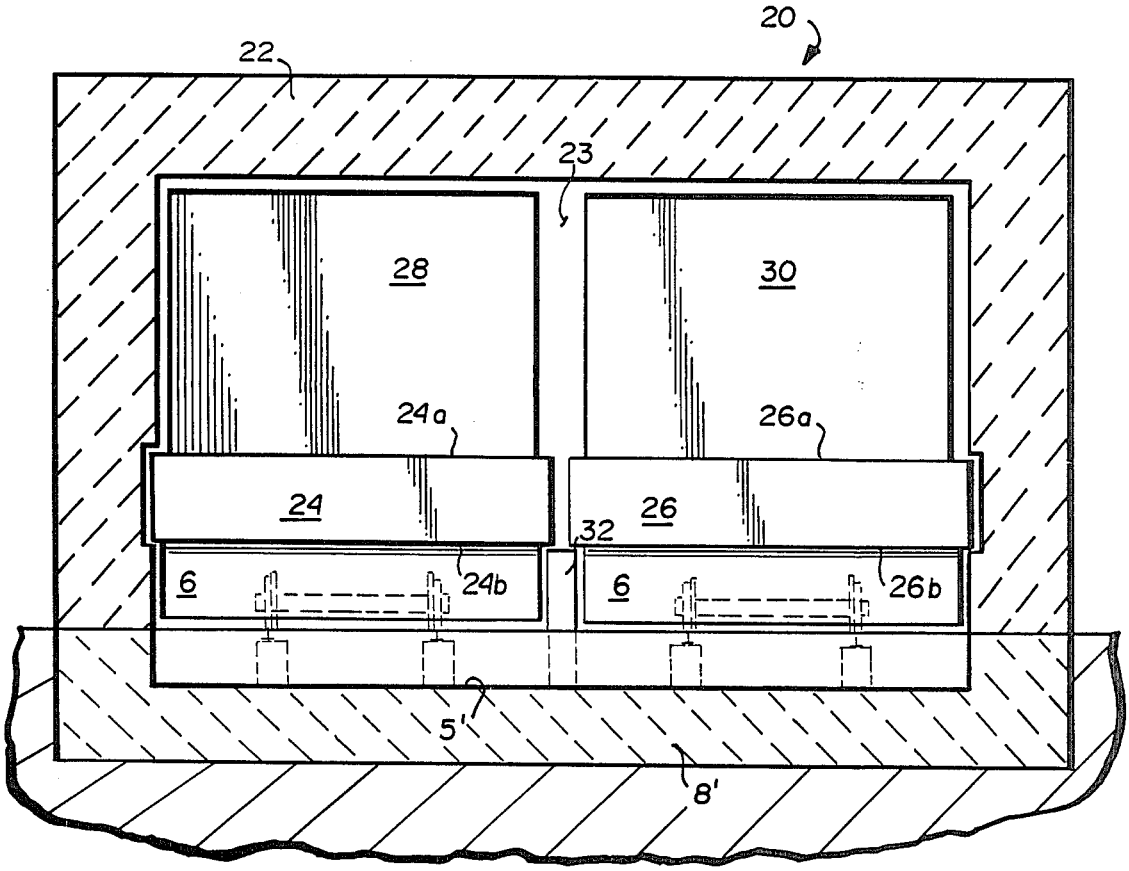
FIG. 5 is a cross-sectional end elevational view of a multitrain tunnel kiln according to this invention.

FIG. 5 schematically depicts (in cross-sectional end elevational view) a multitrain tunnel kiln system 20 in accordance with a further embodiment of this invention. Tunnel kiln system 20 is particularly well suited for being adapted to include the undercarriage cooling means described above with reference to FIGS. 1–4. Particularly, system 20 of FIG. 5 includes a tunnel kiln 22 of suitable refractory material which defines an elongated tunnel 23 therein. Kiln cars 24, 26 of laterlly adjacent trains thereof are provided with a deck **24*a*, 26*a* so as to support thereon uncured refractory material 28, 30**.

As with the embodiment of FIG. 1, the foundation 8' of the kiln 20 takes the form of a trough with the floor of the foundation 8' lowered far enough to provide a continuous depress undercar channel 5' below the aprons 6. A pedestal 32 projects upwardly from the foundation 8' of the kiln 20 to a location corresponding to the underside **24*b*, 26*b* of each kiln car 24, 26, respectively. The aprons 6 thus transversely extend between the raised pedestal 32 and the sidewalls of kiln 52 such that little (e.g., less than 10 millimeters), if any clearance exists therebetween. Of course, if more than two trains of laterally adjacent kiln cars are provided, then the aprons 6 of those kiln cars in the interior trains will transversely extend between a laterally adjacent pair of pedestals 32. Similarly, the bottom of aprons 6 is likewise positioned relative to the foundation 8' of the kiln 22** in such a manner that little (e.g., less than 10 millimeters), if any clearance exists therebetween.

Undercarriage cooling of the side-by-side parallel trains of kiln cars 24 and 26, respectively, may then proceed in accordance with the techniques disclosed in, for example, my earlier co-pending U.S. application Ser. Nos. 930,924, now U.S. Pat. No. 4,722,682 and/or 011,948 now U.S. Pat. No. 4,744,750.

While only a few exemplary embodiments of this invention have been described in detail, those skilled in the art will recognize that many modifications and variations may be made in these embodiments while yet retaining many of the novel features and advantages of this invention. All such modifications and variations are intended to be included within the scope of the appended claims.

What is claimed is:

1. A kiln car adapted for use in an elongated tunnel kiln having transverse sub-chambers located at predetermined intervals along its bottom and for controlled undercar cooling, said kiln car comprising:

a deck portion having an upper surface for supporting uncured ceramic articles for kiln curing, and a lower surface;

means for supporting said deck portion in spaced relation to the tunnel kiln bottom wall so as to establish a lower tunnel chamber therebetween; and transverse aprons depending downwardly at said predetermined intervals from said deck portion and extending to closely adjacent the tunnel kiln bottom wall to thereby provide means which substantially prevent longitudinal air flow through the lower tunnel chamber.

2. A kiln car adapted for use in an elongated tunnel kiln of the type having elongated top, side and bottom walls thereby defining an elongated tunnel, said kiln car comprising:

a deck portion having an underside and a top side on which uncured articles may be stacked for kiln curing;

undercarriage means for supporting said deck portion in spaced relation to said bottom of said tunnel kiln during passage of said kiln car through said elongated tunnel such that said deck portion passes in close proximity to said side walls so as to define thereabove an upper kiln firing tunnel channel and to define therebelow a lower tunnel chamber in which said undercarriage means is adapted to being positioned; and at least one transverse apron depending downwardly from said underside of said deck portion and terminating in close proximity to the tunnel kiln bottom wall so that when a plurality of said kiln cars are in train formation, adjacent ones of said transverse aprons define therebetween respective sub-chambers of said lower tunnel chamber, said transverse apron providing means which substantially prevent longitudinal air flow through said lower tunnel chamber.

3. A kiln car as in claim 2, wherein several of said transverse aprons depend downwardly from said deck portion underside.

4. A kiln car as in claim 3, wherein one and another of said several transverse aprons depend downwardly from leading and trailing regions, respectively, of said deck portion underside.

5. A kiln car as in claim 3, wherein one of said several transverse aprons depends downwardly from approximately a mid-region of said deck portion underside.

6. A kiln car as in claim 2, wherein said transverse apron consists essentially of steel plate.

7. A tunnel kiln including a heat-up zone, a firing zone, and a cooling zone, and a lower tunnel chamber, said tunnel kiln comprising:

elongated top and bottom walls, and an opposing pair of elongated tunnel walls which together define an elongated tunnel chamber;

means establishing multiple parallel paths through said elongated tunnel chamber so as to permit multiple trains of kiln cars to pass in parallel therethrough;

said path establishing means including at least one pedestal upwardly projecting from said bottom wall, wherein said lower tunnel chamber in at least said heat-up zone being divided transversely into plural sub-chambers by transversely situated dividers;

said lower tunnel chamber in at least said cooling zone including a depressed undercar channel; and cooling means disposed to transfer heat from said depressed undercar channel.

8. A tunnel kiln as in claim 7 wherein the cooling means comprises means for forcing an air flow longitudinally along said depressed undercar channel.

9. A multitrain tunnel kiln system comprising:

means defining an elongate tunnel;

a plurality of kiln cars, some of which are arranged in a first train while the others are arranged in a second train; and means establishing parallel paths of convenyance through said tunnel so that said first and second trains of kiln cars are capable of passing therethrough in parallel, wherein said parallel path establishing means includes an elongate pedestal projecting upwardly from a bottom of said tunnel to a location spaced thereabove, and positioned longitudinally within said tunnel between said first and second trains of kiln cars, wherein said kiln cars include:

(a) a deck portion having a top side for supporting uncured refractory material thereon, and an underside, (b) undercarriage means for supporting said deck portion in spaced relation to said bottom of said tunnel kiln during passage of said kiln car through said elongated tunnel such that said deck portion defines thereabove an upper kiln firing tunnel channel and defines therebelow first and second lower tunnel chambers associated with said first and second trains of said kiln cars in which said undercarriage means thereof are respectively positioned; and wherein (c) predetermined ones of said kiln cars of said first and second trains thereof include at least one transverse apron depending downwardly from said underside of said deck portion and extend transversely between said pedestal and a side wall of said tunnel so that longitudinally adjacent ones of said transverse aprons of said kiln cars of said first and second trains thereof define therebetween respective sub-chambers of said lower tunnel chamber.

10. A multitrain tunnel kiln system as in claim 9, further comprising cooling means for cooling the underside of said kiln cars.

11. A multitrain tunnel kiln system as in claim 10 wherein said cooling means disposed to transfer heat from said depressed undercar channel.

12. A multitrain tunnel kiln having a heat-up zone, firing zone and cooling zone and adapted for controlled undercar cooling and including elongated bottom, side and top structures through which kiln cars may be passed in train formation, said kiln comprising:

pedestal means projecting upwardly from said bottom structure to establish an adjacent pair of parallel paths through said tunnel kiln so that respective trains of kiln cars may be passed therethrough; wherein at least one of said paths includes a depressed undercar channel extending longitudinally only along a latter portion of said kiln including at least a part of one of said firing and cooling zones; and cooling means disposed to transfer heat from said depressed undercar channel.

13. A multitrain tunnel kiln as in claim 12 wherein each of said at least one pair of paths includes said depressed undercar channel and said cooling means.

14. A multitrain tunnel kiln as in claim 13 wherein said cooling means comprises means for forcing an air flow longitudinally along said depressed undercar channel.

* * * * *